US007992339B2

(12) United States Patent
Hinds, Jr.

(10) Patent No.: US 7,992,339 B2
(45) Date of Patent: Aug. 9, 2011

(54) GUN WITH INTERNALLY STORED BIPOD

(76) Inventor: Richard A. Hinds, Jr., West Columbia, SC (US)

( * ) Notice: Subject to any disclaimer, the term of this patent is extended or adjusted under 35 U.S.C. 154(b) by 56 days.

(21) Appl. No.: 12/668,417

(22) PCT Filed: Jul. 10, 2008

(86) PCT No.: PCT/US2008/069650
§ 371 (c)(1),
(2), (4) Date: Jan. 9, 2010

(87) PCT Pub. No.: WO2009/009663
PCT Pub. Date: Jan. 15, 2009

(65) Prior Publication Data

US 2010/0192449 A1 Aug. 5, 2010

Related U.S. Application Data

(60) Provisional application No. 60/949,118, filed on Jul. 11, 2007.

(51) Int. Cl.
*F41C 27/00* (2006.01)

(52) U.S. Cl. ..... 42/94; 89/37.04

(58) Field of Classification Search ..... 42/94, 97, 42/71.01; 89/37.01, 37.03, 37.04
See application file for complete search history.

(56) References Cited

U.S. PATENT DOCUMENTS

| | | | | | |
|---|---|---|---|---|---|
| 716,158 | A | * | 12/1902 | Wheeler | 42/94 |
| 1,359,726 | A | * | 11/1920 | Morrison | 42/94 |
| 2,498,749 | A | * | 2/1950 | Benson | 42/94 |
| 3,327,422 | A | * | 6/1967 | Harris | 42/94 |
| 4,776,124 | A | | 10/1988 | Clifton | 42/94 |
| 5,029,407 | A | * | 7/1991 | Kirkpatrick | 42/94 |
| 5,377,437 | A | | 1/1995 | Underwood | 42/94 |
| 5,852,892 | A | * | 12/1998 | Bilgeri et al. | 42/94 |
| 6,289,622 | B1 | * | 9/2001 | Desch | 42/94 |
| 7,770,320 | B1 | * | 8/2010 | Bartak | 42/94 |
| 2008/0307689 | A1 | * | 12/2008 | Dotson | 42/94 |

OTHER PUBLICATIONS

Copenheaver, International Search Report and Written Opinion of ISA, PCT/US08/69650, Dec. 31, 2008.

* cited by examiner

*Primary Examiner* — Michael Carone
*Assistant Examiner* — Jonathan C Weber
(74) *Attorney, Agent, or Firm* — Michael A. Mann; Nexsen Pruet, LLC

(57) ABSTRACT

A gun stores a bipod when not in use inside its fore-end. A gun rest such as a bipod, an aiming stick or tripod has a stored position where its legs are pushed into channels formed in the fore-end of the stock, approximately parallel to the major axis of the gun barrel, but which can be pulled out and pivoted into an in-use position when the user wishes to steady the barrel of the gun for greater accuracy in shooting. A bracket is mounted to the fore end of the stock to allow the legs of the bipod to be pulled clear of the channels and then rotated down. The legs may be telescoping to a preferred elevation once in the in-use position.

7 Claims, 7 Drawing Sheets

GUN WITH INTERNALLY STORED BIPOD

CROSS-REFERENCE TO RELATED APPLICATIONS

This U.S. National Stage Application arises from PCT/US08/69650, filed 10 Jul. 2008, which itself claims benefit of U.S. Provisional Application No. 60/949,118, filed 11 Jul. 2007.

BACKGROUND OF THE INVENTION

The present invention relates to monopods, bipods, tripods and aiming sticks used in connection with guns.

Marksmanship with a gun, particularly at long range, is improved by using a bipod, tripod or aiming stick. These devices support the barrel end of the gun and eliminate some or most all of the motion of the barrel prior to firing. This motion can come, for example, from the heartbeat or breathing of the marksman holding the gun.

The typical bipod is mounted to the barrel at the fore end of the gun and has two positions, a stored position with the two legs folded approximately parallel to and against the fore end, and an in-use position with the two legs unfolded so that they are approximately perpendicular to the fore end and splayed to provide triangular support for the fore end at the apex of the triangle thus formed. Many of these types of bipods have telescoping legs so they can be ground-engaging regardless of whether the marksman chooses to be prone, kneeling or standing.

A tri-pod improves stability over use of a bipod by placing the fore end at the apex of a tetrahedron. An aiming stick has one leg and eliminates some of the unwanted motion of the barrel as it is aimed and is significantly simpler to manufacture, use and carry than a bipod or tripod.

Bipods work well for the most part but must be rugged so that they do not become bent or broken if the user inadvertently strikes them against a tree or rock while moving across rough terrain. They must also be rust- and corrosion-resistant, and, if part of a military or hunting gun, be capable of taking on camouflage paint. Bipods require frequent cleaning so that they are free of dust, dirt and snagged vegetation, particularly in the case of military use. Rust and dirt may make bipods inoperable.

Thus there remains a need for a more convenient, less troublesome bipod, tripod or aiming stick for use with a gun.

SUMMARY OF THE INVENTION

According to its major aspects and briefly recited, the present invention is a gun resting system incorporated into the fore end of a gun stock wherein the fore portion of the stock, or fore end, has channels formed therein that are dimensioned to receive the legs of a gun rest, such as a bipod, when the bipod legs are in a stored position.

To deploy the bipod, the ends of its legs, that is, its "feet," are pulled approximately parallel to the barrel toward its muzzle to bring the legs to an extended position, clear of the channels in the fore end. Once the bipod's largest section is clear of the fore end channels, the legs may be rotated down and apart into an in-use, splayed position approximately perpendicular to the gun barrel. To store the legs, they are rotated up and together, approximately parallel to the barrel, and then pushed back into the fore end of the stock.

The use of the fore end as a storage place is an important feature of the present invention. Storing the bipod when not in use in the fore end keeps the bipod legs cleaner, avoids damage to them and having them catch on branches when hauling the bipod-equipped rifle through wooded terrain, keeps the weight close to the centerline of the gun, makes the gun easier to transport and stack with other rifles, and stores the legs out of the way when not in use, giving the gun a trimmer appearance.

In addition, storing a bipod in the stock fore end makes better use of an existing structure of the gun and enables the bipod to be more securely affixed to the gun without attaching it to the barrel and thereby affecting the barrel's performance characteristics, or without attaching a removable bipod to the fore-stock where it may mar the fore-stock. Additionally, it is possible for the fore end-stored bipod to provide a greater range of heights than externally-added bipods.

These and other features and their advantages will be apparent to those skilled in the art of firearms and firearm accessories from a careful reading of the Detailed Description of Preferred Embodiments accompanied by the following drawings.

DETAILED DESCRIPTION OF THE INVENTION

The present invention is a gun resting system, a gun with the gun resting system, and a stock with the gun resting system.

The term "gun" will refer herein to any firearm having a stock where a portion of the stock extends forward of the trigger but short of the muzzle end of the barrel. Accordingly, it can include small arms such as rifles, pistols and machine guns. The term "fore end" refers to the portion of the stock that extends forward of the trigger and provides a place for the hand of the user to grasp the gun below the barrel with a hand other than the one that will operate the trigger. The fore end of the stock is used to support the forward portion of the firearm while providing protection for the hand of the user from the heat of the barrel.

Figure 1A:
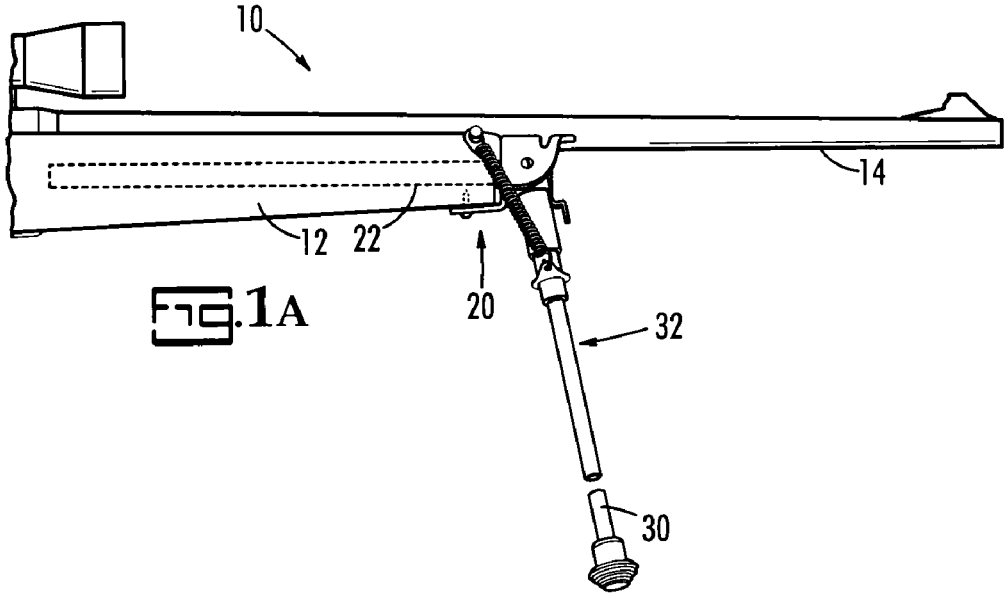
FIGS. 1A, 1B and 1C show in sequence side views of the front end of a gun with the present gun resting system in the form of a bipod, according to a first preferred embodiment of the present invention, in the in-use position in FIG. 1A, in the intermediate extended position in FIG. 1B, and in the stored position in FIG. 1C.
Figure 1B:
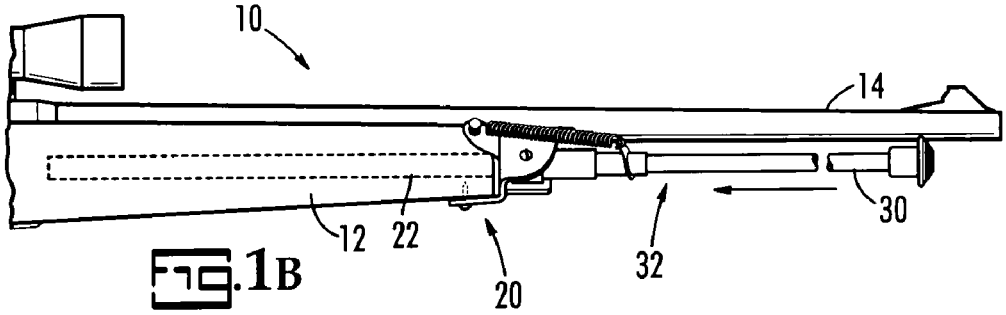
Figure 1C:
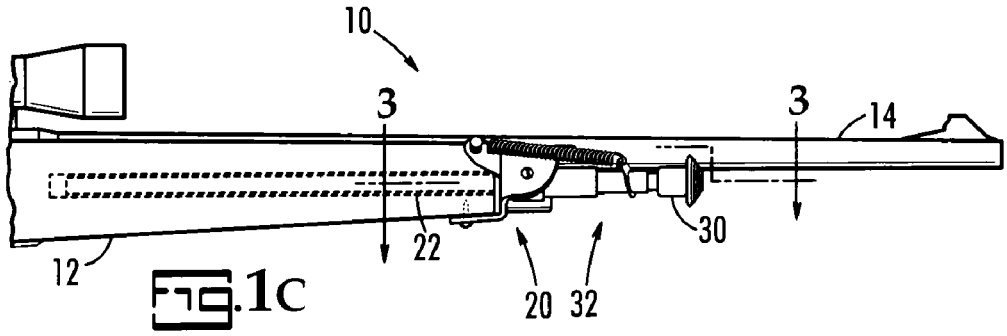

Referring now to the FIGS. 1A-1C, there is illustrated a front portion of a gun 10 having a stock and showing a fore end 12 and a barrel 14. The balance of gun 10 not shown in FIGS. 1A-1C is conventional and includes a receiver and a fire control mechanism operated by a trigger. The operation of gun 10 is also conventional: a round of ammunition is loaded into the receiver where it is positioned adjacent to the proximal end of barrel 14, and its primer is then detonated by the fire control system upon pulling the trigger. The bullet is thus driven down barrel 14 from its proximal end and out its distal end by the kinetic energy of the exploding gun powder in the cartridge, and on to the target, while the cartridge shell casing is expelled from the receiver.

FIG. 1A illustrates the portion of gun 10 showing fore end 12 with a distal end 20 and having a single channel 22 or two channels 22 formed therein. The barrel 14 of gun 10 is supported by legs 30 of a bipod 32 in the in-use position, its legs 30 splayed and oriented approximately perpendicular to the major or long axis of barrel 14. In FIG. 1B, legs 30 have been rotated from being approximately perpendicular to barrel 14, as shown in FIG. 1A, to being approximately parallel to barrel 14, where they are in the intermediate extended position. From the extended position, legs 30 are pushed rearward into channels 22 in fore end 12 to the stored position, as shown in FIG. 1C.

Preferably fore end 12 is sufficiently wide and thick, similar to the type of stock that holds a varmint barrel, and it may be made of wood, plastic such as nylon, or composite material. The distal end 20 of fore end 12, from the perspective of the user of the present gun, is formed with two channels 22, each channel 22 dimensioned to receive one leg 30 of legs 30 of bipod 32.

Figure 2:
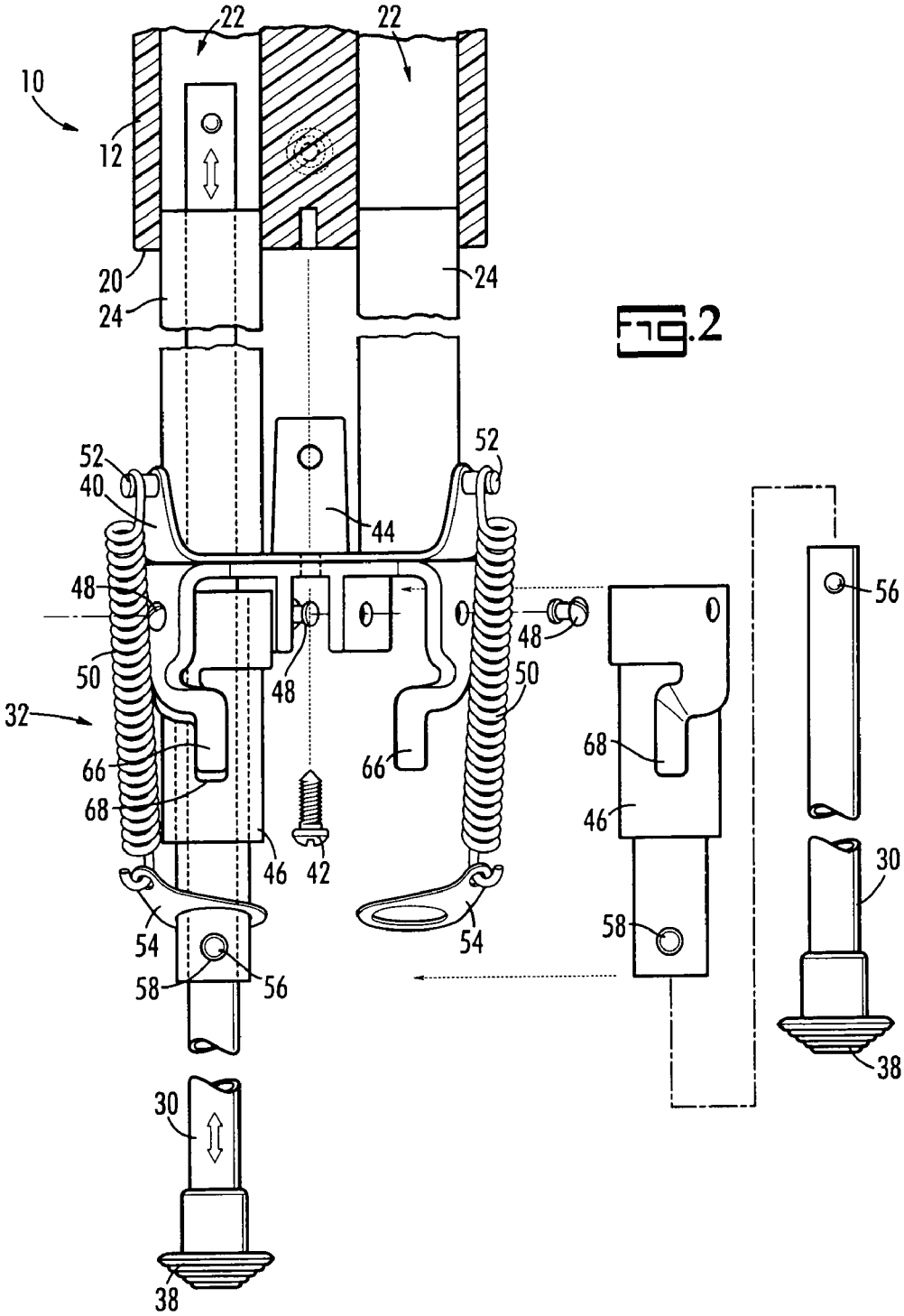
FIG. 2 illustrates a bottom, partially-exploded, partial cross-sectional view of the bipod of FIG. 1B, according to the preferred embodiment shown in FIGS. 1A-1C.
Figure 3:
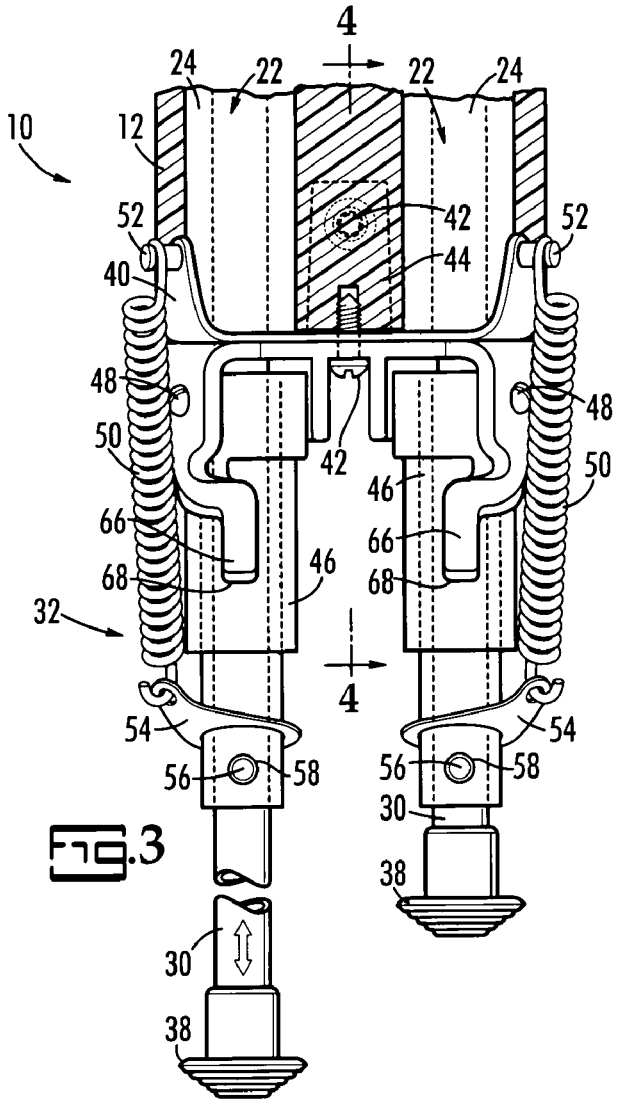
FIG. 3 illustrates a top, partial cross-sectional view of the bipod of FIG. 1C according to the preferred embodiments of FIGS. 1A-1C.
Figure 4:
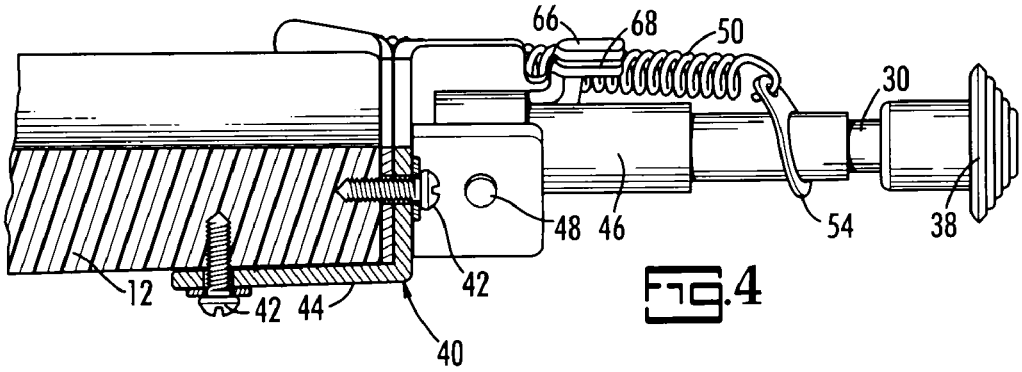
FIG. 4 is a cross-sectional view taken along line 4-4 of FIG. 3.

Referring now to FIGS. 2, 3 and 4, channels 22 are formed by boring or by molding fore end 12 and are preferably fitted with metal sleeves 24 for strength and wear resistance. Channels 22 have a major axis that is approximately parallel to the major axis of barrel 14.

The openings of channels 22 are at distal end 20 of fore end 12. Preferably, legs 30 have feet 38 that extend slightly beyond distal end 20 of fore end 12 when bipod 32 is in the stored position, as shown in FIG. 1C. In this position, feet 38 can be easily accessed and used as convenient handles for pulling legs 30 approximately parallel to barrel 14 to the extended position shown in FIG. 1B.

A bracket 40 is attached to distal end 20 of fore end 12, preferably by at least one screw 42 (as best seen in FIG. 4), including one screw 42 through a tang 44 that is part of bracket 40 but oriented to engage the underside of fore end 12 at its distal end 20. Legs 30 are held by bracket 40 so that they can slide freely through collars 46 of bracket 40 between the stored position (FIG. 1C), inside channels 22, and the extended position (FIG. 1B), where legs 30 are pulled clear of channels 22 but remain still approximately parallel to barrel 14. From the extended position, legs 30 may be rotated downward about pivot pins 48 of bracket 40 to move legs 30 from extended position (FIG. 1B) to in-use position (FIG. 1A). Preferably, legs 30 spread apart or splay when rotated to the in-use position, a position approximately perpendicular to the major axis of barrel 12.

Bracket 40 has arms 66 for limiting the pivoting of legs 30 to no further than approximately parallel to barrel 14. Collars 46 also have arms 68 for engaging arms 66 of bracket 40 when legs 30 have been rotated from the in-use positions to the extended positions. Arms 66 of bracket 40 prevent arms 68 of collars 46 from continuing to pivot once they close on each other.

To assist legs 30 in moving from one position to another in the embodiment shown, springs 50 are attached to bracket 40 at anchors 52 on one end and to tabs 54 at the other. When legs 30 are moved between the extended and the in-use position, springs 50 are stretched and tend to urge legs 30 to the extended or the in-use positions rather than to remain in any intermediate position. Legs 30 may telescope, that is, they are made of sections that fit within each other but which sections may be slid axially with respect to each other to form a longer support member, and which may use any convenient way of locking the sections in their extended or their compact configuration, such as spring loaded ball detents 56 on smaller shafts of legs 30 that extend into holes 58 in the next larger shaft of legs 30, as shown, or annular grooves and a spring loaded stop that catches the grooves. Preferably, legs can provide not less than approximately 6 inches of elevation in their most compact configuration to a fully extended configuration. Most preferably, the legs provide suitable ranges of elevation for different users and different positions, including a prone position, a bench resting positions, a kneeling position, a sitting position and a standing position. A reasonable amount of experimentation can be used to determine the appropriate ranges for at least two positions for each gun rest. However, a range of 6½ inches to 13 inches for prone to bench positions and 9½ to 27 inches for prone to sitting positions are recommended.

Figure 5:
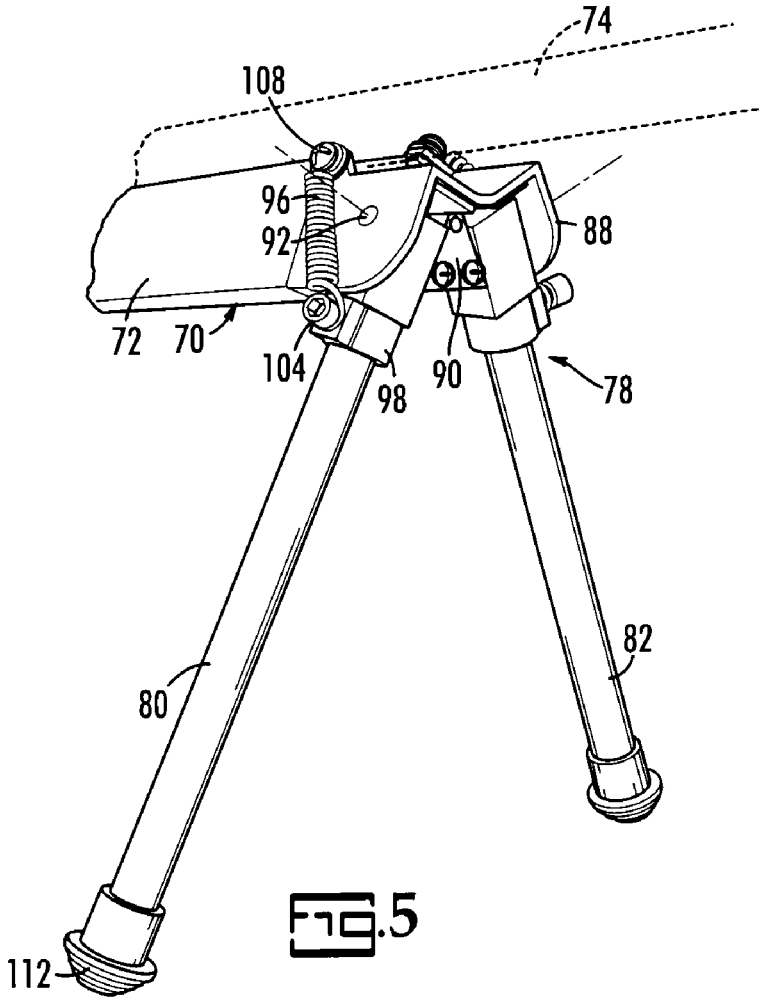
FIG. 5 is a partial perspective view of the fore end of an otherwise typical gun having a resting system according to an alternative embodiment of the present invention.

FIG. 5 illustrates in perspective another preferred embodiment of the present invention. FIG. 5 shows a fore end 70 of a stock 72 with a portion of a gun barrel 74 shown in phantom lines just above stock 72.

As seen in FIG. 5, a bipod 78 is carried by stock 72 but shown in the in-use configuration with two legs: first leg 80 and second leg 84, shown extended from stock 72, folded approximately perpendicular to barrel 74 and splayed, similar to the configuration of legs 32 shown in FIG. 1A.

Figure 6A:
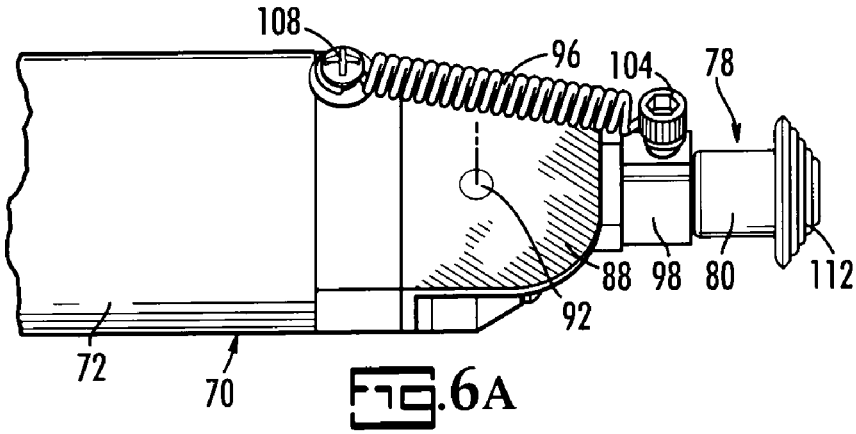
FIG. 6A-6C are side views of the fore end of the gun of FIG. 5 having the alternate embodiment of the present gun resting system in the stored, intermediate extended and in-use positions, respectively.
Figure 6B:
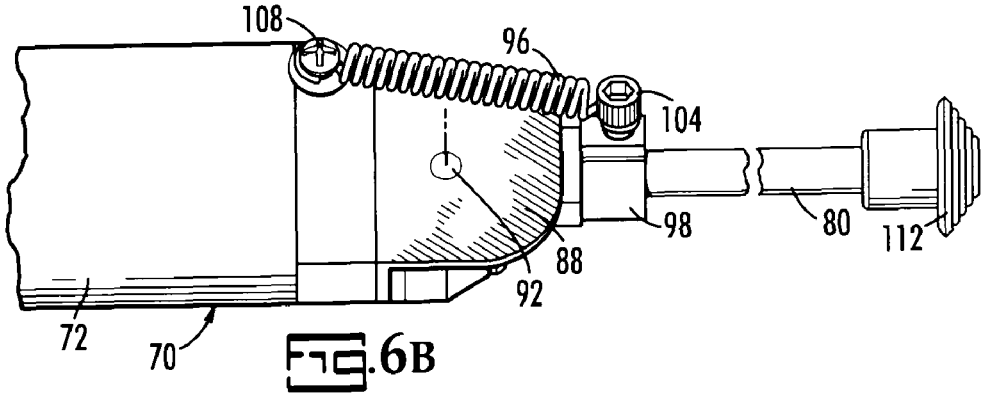
Figure 6C:
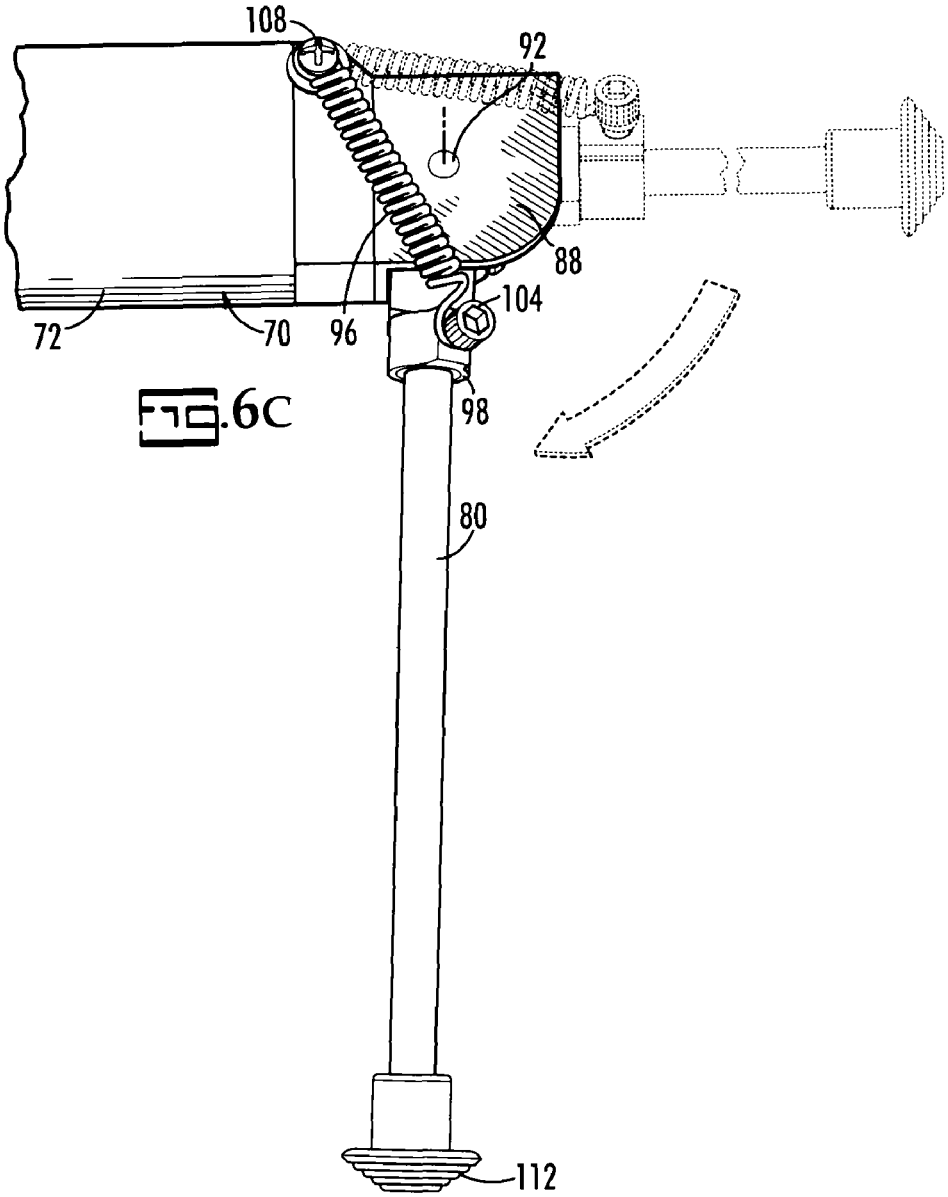

FIG. 6A illustrates a detailed, side view of bipod 78 in the stored configuration. FIGS. 6B and 6C illustrate the same view of bipod 78 but with first and second legs 80, 84 in the extended and in-use configurations, respectively.

Bipod 78 includes a bracket 88 mounted to fore end 70 of stock 72 and a brace 90 (see FIG. 5). Bracket 88 and brace 90 hold first and second legs 80, 84 at an appropriate, splayed angle when in the in-use configuration for providing stable support for barrel 74. When first and second legs 80, 84, are folded up to the extended position (FIG. 6B), first leg 80 pivoting about first pivot pin 92 and second leg 84 pivoting about second pivot pin 94 (second pivot pin 94 best seen in FIG. 10). First and second legs 80, 84, are then parallel to each other in the extended position (comparable to that shown in FIG. 1B). From the extended position, first and second legs 80, 84 can be pushed into fore-stock 72 into the stored configuration, as shown in FIG. 6A.

Figure 7:
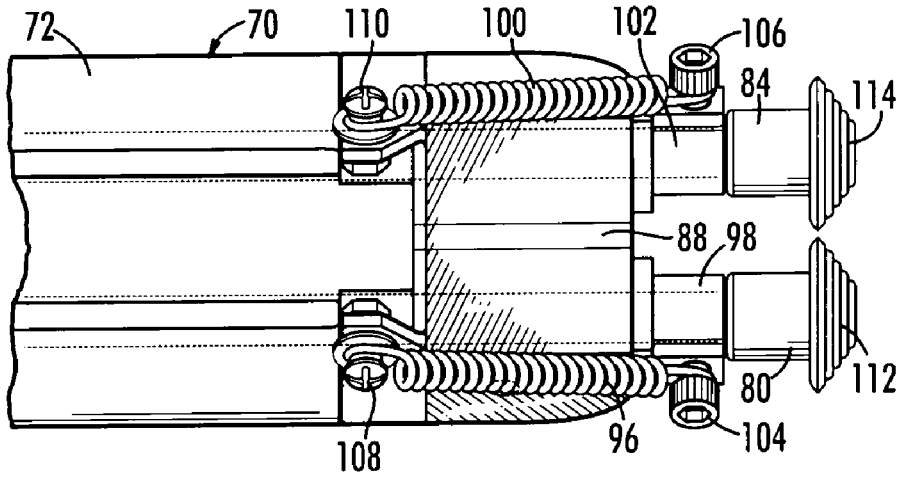
FIG. 7 is a top view of a portion of the fore end gun of FIG. 5 having the gun resting system according to the alternate embodiment of the present invention.

As best seen in FIG. 7, bipod 78 includes a first spring 96 connected to first leg 80 via a first collar 98 and a second spring 100 connected to second leg 84 via a second collar 102. First and second springs 96, 100 are extension springs and are extended when first and second legs 80, 84 are moved from the stored configuration (FIG. 6B) but the extension is relieved when first and second legs 80, 84, are then folded the remainder of the way, to the in-use positions (FIG. 6C). First and second springs 96, 100, thus bias legs 80, 84 from the extended and in-use positions and away from intermediate positions.

As shown in FIG. 7, the positions of first and second collars 98, 102, clearly affect the tension on first and second springs 96, 100. As first and second collars 98, 102, are moved axially away from bracket 88, the tension on first and second springs 96, 100, increases and with it the bias toward the extended and in-use positions and the relative difficulty of moving first and second legs 80, 84 from these positions. For mounting and adjusting tension on springs 96, 100, collars 98, 102, can be rotated after loosening nuts 104, 106.

First and second legs 80, 84, may telescope and terminate in first and second feet 112, 114, respectively, which also serve as convenient handles for pulling the smallest diameter sections of first and second legs 80, 84 from the larger diameter sections. The number of co-axial sections that comprise telescoping legs 80, 84 will determine the typical convenient heights needed by the user, and the size of the fore end 70, because the fore end size will limit the size of longest section, which then, together with the maximum desired height, determines the number of sections. For example, for firing in a prone position, a height of nine or ten inches may be sufficient and, if the fore end is at least that long, one section will be sufficient. If the gun is to be fired by a user in the kneeling position, an elevation of approximately 36 inches would require four sections if the fore end 70 of stock 72 is 10 inches long. Nuts 104 and 106 may be tightened or loosened to allow the sections of telescoping first and second legs 80, 84 to move a little less or a little more easily. The opposing ends of first and second springs 96, 100, are attached to bracket 88 by screws 108, 110.

Figure 8:
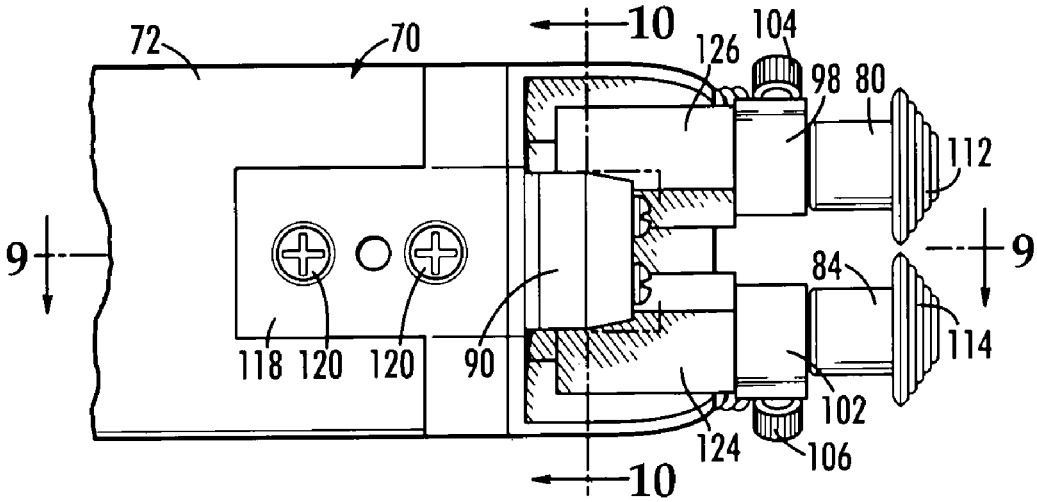
FIG. 8 is a bottom view of a portion of the fore end of the gun of FIG. 5 having the gun resting system according to the alternate embodiment of the present invention.
Figure 9:
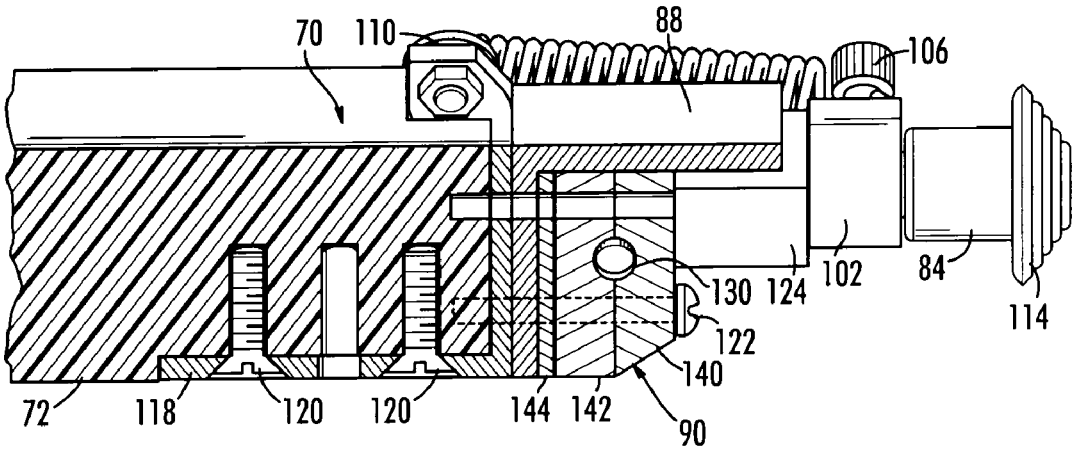
FIG. 9 is a side cross-sectional view, taken along line 9-9 of FIG. 8, of a portion of a gun having the gun resting system according to the alternate embodiment of the present invention.
Figure 10:
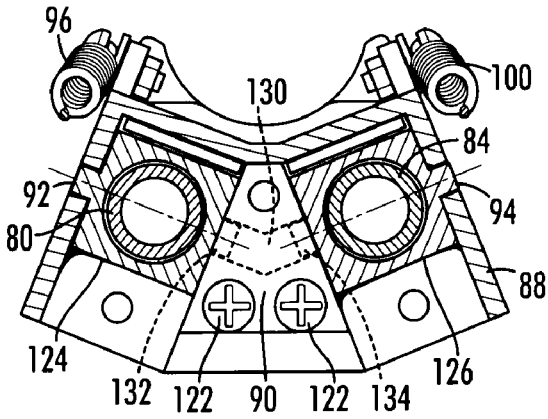
FIG. 10 is an end cross-sectional view, taken along line 10-10 of FIG. 8, of a portion of a gun having the gun resting system according to the alternate embodiment of the present invention.

Bracket 88 is secured to fore end 70 from underneath where a tang 118 extends rearward (away from the muzzle end and toward the receiver), as best seen in FIG. 8 but also visible in FIG. 9. Two screws 120 hold tang 118 to fore end 70. Two more screws 122 hold brace 90 to the end of fore end 70 and in turn hold bracket 88 fast to fore end 70. See also FIGS. 9 and 10. Brace 90 assures the alignment of first and second legs 80, 84, the ends of which are secured in a first and a second leg pivot housing 124, 126, which carry first and second pivot pins 92, 94, respectively (FIG. 10). Brace has an angled hole 130 (or two separate holes) formed in it for receiving a first and second pivot pin 132, 134, that correspond to pivot pins 92, 94 in that they are axially aligned with each other; first pin 92 is axially aligned with first pin 132, and second pivot pin 94 is axially aligned with second pivot pin 134. Preferably, first pivot pin 92, first pivot housing 124, and first pivot pin 132 are integrally formed, as is second pivot pin 94, second pivot housing 126, and second pivot pin 134. Thus brace 90 serves two functions: it helps to position first and second legs 80, 84, in bracket 88 and it serves as a bearing for first and second pivot pins 132, 134.

Brace 90 is conveniently made in two parts, a front part 140 and a rear part 142 to facilitate assembly. In addition, a shim 144 inserted between bracket 88 and rear part 142, may be used to tighten front and rear parts 140, 142 together about first and second pivot pins 132, 134.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A gun, comprising:

(a) a stock having a fore end;

(b) a receiver carried by said stock;

(c) a barrel attached to said receiver, said barrel having a major axis, said stock including a fore end portion forward of said receiver for supporting said barrel, said fore end having a channel formed therein having an opening;

(d) a fire control system carried by said receiver and operated by a trigger for enabling a user to fire a round of ammunition through said barrel;

(e) a bracket attached to said fore end of said stock;

(f) a brace attached to said bracket;

(g) a first pivot housing and an opposing second pivot housing, said first and said second pivot housing bearing on said brace and being pivotally carried by said bracket, said first and second pivot housing having a hole formed therein;

(h) two parallel, spaced-apart channels formed in said fore end of said stock;

(i) a first leg slidably carried in said hole of said first pivot housing, said first leg dimensioned to fit within said first channel and to slide between a stored position in said first channel and an extended position outside said first channel, said first leg pivoting with said first pivot housing when said first leg is pivoted from said extended position to an in-use position approximately perpendicular to said barrel;

(j) a second leg slidably carried in said hole of said second pivot housing, said second leg dimensioned to fit within said second channel and to slide between a stored position in said second channel and an extended position outside said second channel, said second leg pivoting with said second pivot housing when said second leg is pivoted from said extended position to an in-use position approximately perpendicular to said barrel, said brace being formed so that, when said first and said second pivot housing are pivoted with respect to said brace, said first and second legs, pivotally carried by said first and second pivot housings, respectively, are parallel in said extended position and splayed in said in-use position;

(k) a first foot carried by said first leg and extending from said fore end of said stock when said first leg is in said stored position, said first foot serving as a handle for moving said first leg from said stored position to said extended position; and (l) a first foot carried by said first leg and extending from said fore end of said stock when said first leg is in said stored position, said second foot serving as a handle for moving said second leg from said stored position to said extended position.

2. The gun as recited in claim 1, wherein said first and said second legs are telescoping.

3. The gun as recited in claim 1, wherein said bracket has a tang and said fore end of said stock has a side opposite said barrel, and wherein said tang is attached to said side of said fore end of said stock opposite said barrel.

4. The gun as recited in claim 3, wherein said brace is attached to said fore end of said stock.

5. The gun as recited in claim 1, further comprising a first spring and a second spring for urging said first leg and said second leg, respectively, to said stored and to said in-use position from said extended position.

6. The gun as recited in claim 5, wherein tension on said first and said second spring is adjustable.

7. The gun as recited in claim 5, further comprising a first collar carried by said first leg and a second collar carried by said second leg, said first and second springs having first ends being attached to said bracket and opposing second ends attached to said first and second collars, respectively.

* * * * *